US006915541B2

(12) United States Patent
Alexander

(10) Patent No.: US 6,915,541 B2
(45) Date of Patent: Jul. 12, 2005

(54) WATER-OPERATED WASH BRUSH

(75) Inventor: Gus Alexander, Inverness, IL (US)

(73) Assignee: FAIP North America, Inc., Elk Grove Village, IL (US)

( * ) Notice: Subject to any disclaimer, the term of this patent is extended or adjusted under 35 U.S.C. 154(b) by 0 days.

(21) Appl. No.: 10/391,866

(22) Filed: Mar. 19, 2003

(65) Prior Publication Data

US 2004/0181886 A1 Sep. 23, 2004

(51) Int. Cl.[7] ..... A46B 13/06
(52) U.S. Cl. ..... 15/29
(58) Field of Search ..... 15/24, 29

(56) References Cited

U.S. PATENT DOCUMENTS

| | | | | | |
|---|---|---|---|---|---|
| 2,540,240 | A | | 2/1951 | Boyle | 15/29 |
| 2,678,457 | A | * | 5/1954 | Demo et al. | 15/29 |
| 3,114,164 | A | * | 12/1963 | Riordan | 15/29 |
| 4,084,281 | A | * | 4/1978 | Smith | 15/29 |
| 4,513,466 | A | * | 4/1985 | Keddie et al. | 15/29 |
| 4,679,270 | A | | 7/1987 | Gaiti et al. | 15/29 |
| 4,686,729 | A | * | 8/1987 | Roman et al. | 15/29 |
| 4,757,565 | A | * | 7/1988 | Sanchez | 15/29 |
| 4,809,382 | A | * | 3/1989 | Ravn | 15/29 |
| 5,007,127 | A | | 4/1991 | Paolo | 15/29 |
| 5,129,121 | A | * | 7/1992 | Gelman | 15/29 |
| 5,400,468 | A | * | 3/1995 | De Petra | 15/394 |
| 5,619,766 | A | * | 4/1997 | Zhadanov et al. | 15/29 |
| 5,913,982 | A | * | 6/1999 | Phillips | 134/6 |
| 6,021,539 | A | * | 2/2000 | Zhadanov et al. | 15/29 |

FOREIGN PATENT DOCUMENTS

| | | | |
|---|---|---|---|
| DE | 1 021 147 | | 12/1957 |
| FR | 2 555 951 | A1 | 6/1985 |
| FR | 2568120 | * | 1/1986 |
| JP | 5-23218 | * | 2/1993 |
| JP | 2000-337239 | * | 12/2000 |

* cited by examiner

*Primary Examiner*—Mark Spisich
(74) *Attorney, Agent, or Firm*—Leydig, Voit & Mayer, Ltd.

(57) ABSTRACT

A water-operated wash brush which includes a casing that supports a rotary brush and an impellor which drives the rotary brush through a gear train as an incident to direction of wash liquid into the casing from a tangential nozzle. The casing has a clear plastic cover for observing rotary operation of the impellor with the gear train being ascetically disposed on an underside of the impellor. A circular splash plate is interposed between the gear train and the rotary brush for preventing the splash back of wash liquid that might impede operation of the gear train.

6 Claims, 1 Drawing Sheet

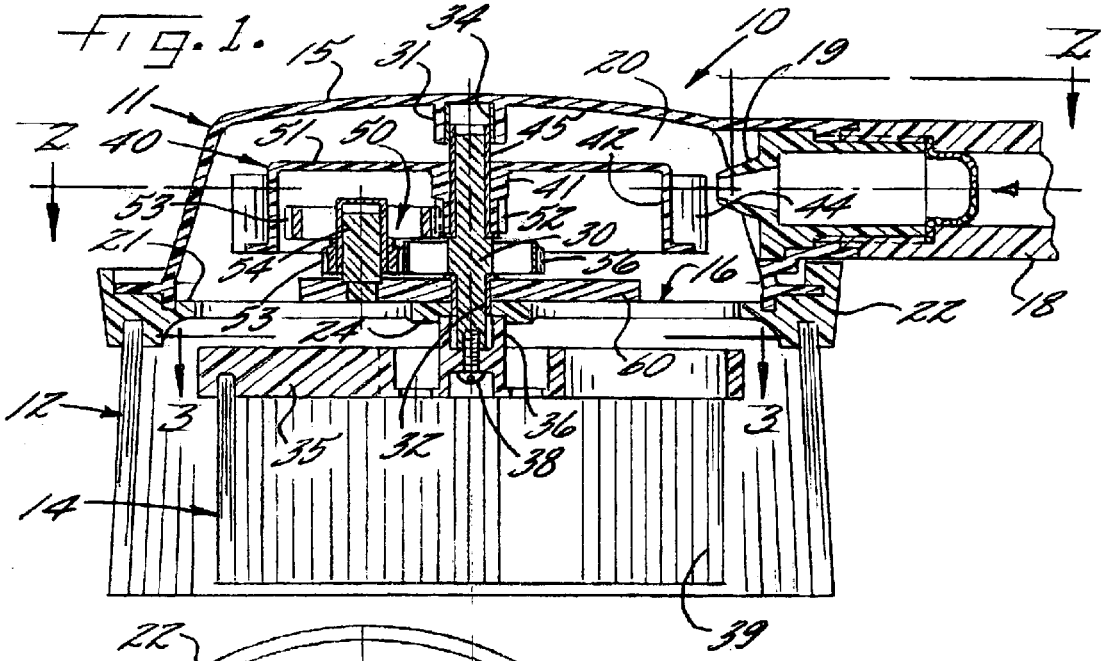
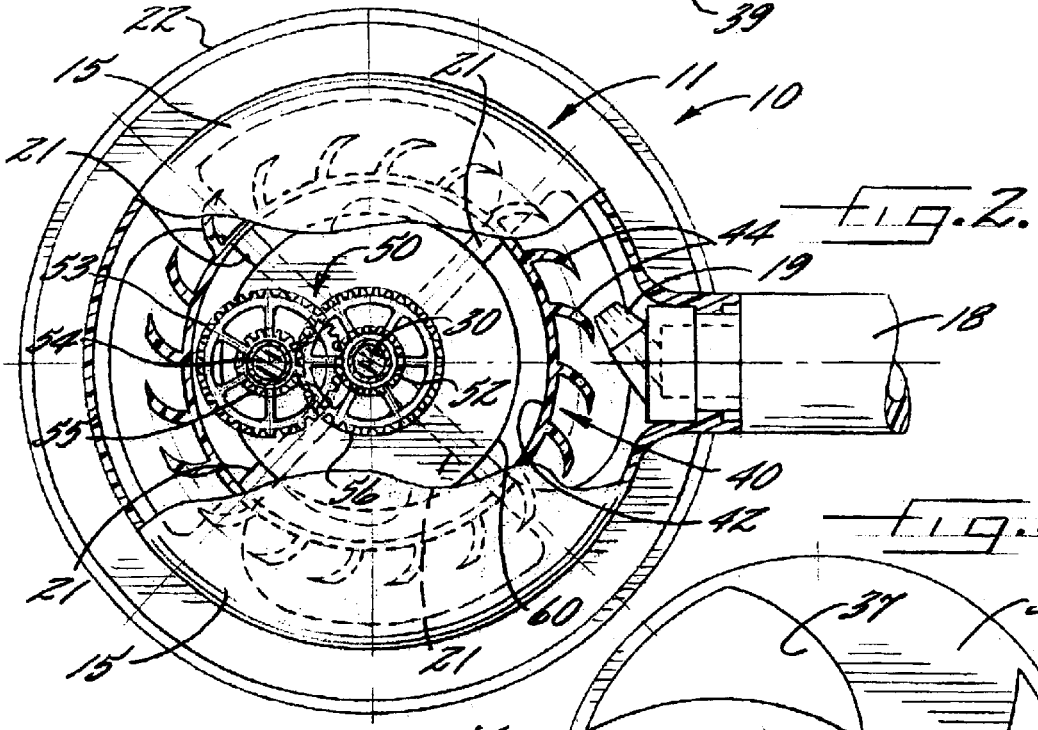
Fig. 2.
Fig. 3.
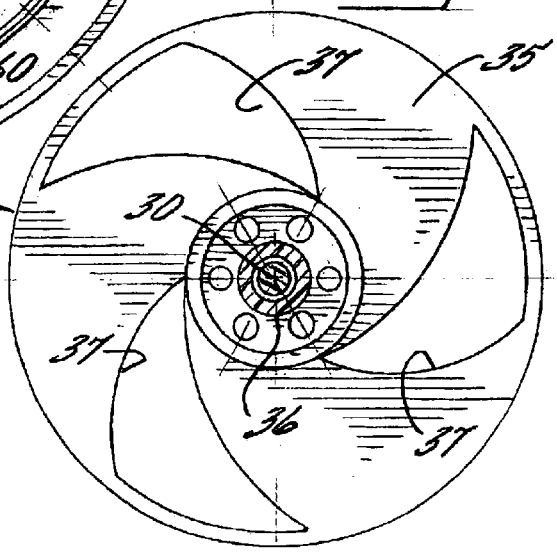
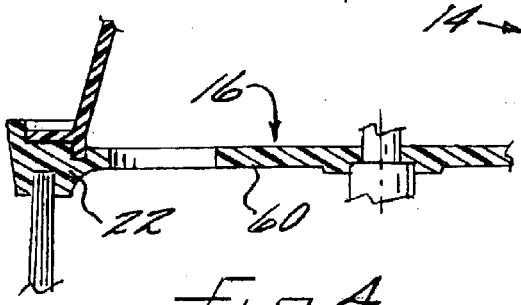
Fig. 4.

WATER-OPERATED WASH BRUSH

FIELD OF THE INVENTION

The present invention relates generally to wash brushes, and more particularly, to wash brushes which are rotatably operated by the water or other washing fluid directed into and through the brush.

BACKGROUND OF THE INVENTION

Water-operated wash brushes are known for use in many cleaning applications, such as cleaning floors, walls, mechanical work pieces, and vehicles. Such wash brushes commonly include an upper casing into which a nozzle forcefully directs a tangential jet of water that rotatably drives a turbine-like impellor, which in turn through appropriate reducing gears, drives a wash brush supported in depending relation to the casing at a rotary speed less than the turbine. The wash brush is constantly wetted by the water that produces the brush rotation.

In order to protect the reducing gears from the water stream so as not to impede rotary operation of the brush, it is known to form the impellor with an upwardly opening recess, which together with the top of the casing, defines a protective chamber. A disadvantage of such design is that all of the gearing must be supported by the top of the casing, which can cause assembly difficulties. With the gearing contained within the chamber between the impellor and the top of the casing, they also are not easily accessible. Moreover, it is common to form the casing of inexpensive clear plastic material, which enables the user to observe the operation of the impellor. In such case, with the reducing gears disposed over the turbine, they are directly viewable through the top of the transparent casing, which can detract from the ascetic appearance. Moreover, if the brush is briefly turned in an upside-down direction during a washing operation, water can quickly accumulate in the casing which can impede operation of the brush. While proposals have been made for supporting the reducing gearing on the underside of the impellor, such designs are disadvantageous in that the gears can be exposed to the tangentially directed water stream, which can impede their operation. The gearing further is exposed to water which backsplashes from the rotating brush.

OBJECTS AND SUMMARY OF THE INVENTION

It is an object of the present invention to provide a water-operated wash brush that is adapted for economical manufacture and which has an ascetically pleasing appearance even when assembled with a clear plastic casing.

Another object is to provide a water-operated brush as characterized above which has reducing gears mounted below the impellor for easy assembly and access, but which are effectively protected from liquid that can impede reliable rotary operation of the brush.

Still another object is to provide a water-operated brush which can be operated in an inverted or upside-down condition with less likelihood of accumulating water in the casing that adversely affects operation of the reducing gears and brush.

Other objects and advantages of the invention will become apparent upon reading the following detailed description and upon reference to the drawings, in which:

BRIEF DESCRIPTION OF THE DRAWINGS

FIG. 1 is a vertical section of an illustrative wash brush embodying the present invention;

FIG. 2 is a top view, in partial section, of the wash brush shown in FIG. 1, taken in the plane of line 2—2;

FIG. 3 is a horizontal section, showing the rotary brush, taken in the plane of line 3—3 in FIG. 1; and FIG. 4 is a fragmentary section depicting an alternative embodiment of splash plate for the illustrated wash brush.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

Referring now more particularly to FIG. 1 of the drawings, there is shown an illustrative wash brush 10 in accordance with the invention. The wash brush 10 includes a casing 11 having an outer annular brush 12 fixed in depending relation thereto and a rotary brush 14 supported co-axially within the fixed brush 12 for relative rotation as an incident to the supply of washing liquid to the wash brush. The casing 11 in this case includes a downwardly opening cup-shaped cover 15 and a lower frame plate 16. A hollow support and liquid supply rod 18 is connected in outwardly extending fashion to the cover 15 for coupling to a supply of water or other cleaning fluid in a known manner. A nozzle insert 19 is secured in the downstream end of the rod 18 for forcefully directing a tangential liquid flow stream into an internal chamber 20 defined by the cover 15. The frame plate 16 in this instance includes a plurality of radial spokes 21 which extend between an outer ring 22 from which the fixed brush is supported and a central hub 24. The fixed brush 12 has bristles which extend in slight outwardly extending frustoconical relation to the outer ring 22.

The rotary brush 14 is fixed to a central shaft 30 which is rotatably supported between a central opening in the frame hub 24 and a socket 31 integrally formed in depending relation to the cover 15. Respective bushings 32, 34 are provided between the shaft 30 and the frame hub 24 and socket 31 for facilitating relative rotational movement of the shaft 30. The rotary brush 14 includes an upper base 35 with a central hub 36 that is fixed to the shaft 30 by a bolt 38 and which carries an annular array of downwardly directed bristles 39. The bristles 39 of the rotary brush 14 in this instance extend in substantially parallel relation to the axis of rotation. The base 35 of the illustrated rotary brush 14 is formed with a plurality of circumferentially spaced openings 37.

For rotating the rotary brush 14 as an incident to direction of pressurized water or other cleaning fluid into the casing 11 through the tangential nozzle 19, an impellor 40 is supported on the shaft 30 for relative rotation. The impellor 40 includes a central hub 41 mounted about the shaft 30 and an outer cylindrical sidewall 42 formed with a plurality of equally spaced cordal blades 44 which are driven by discharging liquid from the tangential nozzle 19. A bushing 45 is provided between the impellor hub 41 and the shaft 30 to facilitate relative rotation. Rotary movement of the impellor 40 is transmitted to the rotary brush 14 through a reducing gear train 50.

In accordance with one aspect of the invention, the cover of the brush is made of a transparent material which enables a user to observe operation of the impellor and the speed reducing gear train is disposed below the impellor for more ascetic appearance. To this end, the cover 15 preferably is made of a clear plastic material, which may be economically produced by injection molding, and the impellor 40 has a downwardly opening cup shape which overlies the speed reducing gear train 50. The impellor 40 in this case has an upper horizontal wall 51 disposed adjacent an upper perimeter of the discharge orifice of the nozzle 19 such that the cylindrical sidewall 42 and blades 44 are engaged by the discharging flow stream from the nozzle 19.

For transmitting rotary motion to the rotary brush 14, the reducing gear train 50 in this instance includes gear teeth 52 formed on the impellor hub 41 which cooperate with the teeth of a larger diameter gear wheel 53 supported for rotation about an upwardly turned pin 54 mounted in fixed relation to the frame plate 16. The gear wheel 53 includes a smaller diameter hub formed with gear teeth 55 for in turn driving a larger diameter gear wheel 56 fixed to the shaft 30. Hence, rotational movement of the impellor 40 will drive the central shaft 30 and rotary brush 14 through the gear train 50 at a rotatable speed less than the impellor 14, preferably a rotational speed equal to one-quarter of the rotational speed of the impellor. With the gear train 50 disposed below the impellor, they are hidden when viewed from the top of the brush through the clear plastic cover 15 if the impellor 40 is made of a non-transparent material. Even if the impellor 40 is made of a transparent or translucent material, the gear train is not directly under the cover. In either case, operation of the impellor 40 can be viewed through the cover 15 more ascetically. Since the downwardly opening cup-shaped impellor 40 substantially overlies the reducing gear train 50 of the rotary brush 14, the cylindrical sidewall 42 of the impellor 40 also prevents the liquid flow stream which drives the impellor 40 from directly impinging upon the reducing gears, and furthermore, causes the water to be flung radially outwardly within the cover for direction downwardly through the bristles 39 of the rotary brush 14 without impeding operation of the reducing gear train 50.

In carrying out a further feature of the invention, a splash plate is provided on the underside of the speed reducing gear train for preventing splash back of liquid from the rotary brush that might impede operation of the gear train, and hence, rotary movement of the brush. To this end, a generally circular splash plate 60 is mounted in fixed relation on the casing frame plate 16 about the shaft 30 between the gear train 50 and rotary brush 14. The splash plate 60 preferably has a diameter of at least one-half of the diameter of the impellor, and most preferably, at least three-quarters of the diameter of the impellor, for substantially preventing backsplash of liquid from the rotary brush 14 against the reducing gears and teeth. The upstanding support pin 54 for the gear 53 in this case is supported on the splash plate 60, which in turn is fixed to the casing frame plate 16. Alternatively, as shown in FIG. 4, the splash plate 60 may be an integrally formed part of the frame plate 16.

From the foregoing, it can be seen that the water operated wash brush of the present invention is adapted for efficient and economical manufacture and has an ascetically pleasing appearance even when assembled with a clear plastic casing. While the wash brush has a reducing gear train disposed below the impellor for aesthetic purposes, it is effectively protected from liquid that can impede reliable rotary action of the brush.

What is claimed is:

1. A wash liquid-operated wash brush comprising:

a casing having a downwardly opening top cover, said casing having a liquid inlet for coupling to a wash liquid supply with a nozzle for tangentially directing wash liquid into said casing, a rotary wash brush supported by said casing for relative rotation, an impellor supported by said casing for rotation relative to said rotary brush as an incident to direction of wash liquid into said casing from said nozzle, a gear train coupled between said impellor and rotary brush for rotating said rotary brush as an incident to rotation of said impellor, said cover, being made of a transparent material for enabling a user of said wash brush to observe rotation of said impellor through said cover, said impellor having a downwardly opening cup shape overlying said gear train such that the gear train is located underneath and within the perimeter of the impellor, said casing includes a frame plate on an underside of said cover, a central shaft rotatably supported between said frame plate and cover, said rotary brush being fixed to said central shaft, and said impellor being mounted about said central shaft for relative rotation with respect thereto, a splash plate mounted on said frame plate, said splash plate comprising a generally circular solid and uninterrupted plate disposed between the gear train and the brush for blocking the splash back of liquid from said rotary brush to said gear train during operation thereof, said splash plate having a diameter of at least one-half the diameter of said impellor and further being substantially centered with respect to the axis of rotation of said brush.

2. The wash brush of claim 1 in which said cover is made of a clear plastic material.

3. The wash brush of claim 1 including a non-rotatable annular brush disposed about said rotary brush in fixed depending relation to said casing.

4. The wash brush of claim 1 in which said gear train includes a first gear supported for rotation by a pin mounted in upstanding fixed relation to said frame plate, and a second gear fixed to said central shaft.

5. The wash brush of claim 1 in which said splash plate has a diameter of at least three-quarters the diameter of said impellor.

6. The wash brush of claim 1 in which said splash plate is an integral part of said frame plate.

* * * * *